US005297812A

United States Patent [19]

Dogat et al.

[11] Patent Number: 5,297,812

[45] Date of Patent: Mar. 29, 1994

[54] INTERFACE PLATE FOR THE SLIDE-RAIL OF A MOBILE SKI BINDING, IN PARTICULAR OF AN ALPINE SKI BINDING

[75] Inventors: Vincent Dogat, Annecy; Pascal Thomas, Chambery, both of France

[73] Assignee: Salomon S.A., Chavanod, France

[21] Appl. No.: 990,284

[22] Filed: Dec. 14, 1992

[30] Foreign Application Priority Data

Dec. 13, 1991 [FR] France ..... 91 15832

[51] Int. Cl.[5] ..... A63C 9/00; A63C 9/22

[52] U.S. Cl. ..... 280/633

[58] Field of Search ..... 280/607, 617, 613, 633, 280/634

[56] References Cited

U.S. PATENT DOCUMENTS 3,314,687 4/1967 Tiesler .

5,118,128 6/1992 Piegag et al. ..... 280/633

FOREIGN PATENT DOCUMENTS 2646093 4/1989 France .

*Primary Examiner*—Richard M. Camby

*Attorney, Agent, or Firm*—Pollock, Vande Sande & Priddy

[57] ABSTRACT

An interface plate for the slide-rail of a binding, especially but not exclusively an alpine binding. The slide-rail (2) comprises a base (3) shaped like an "inverted Ω" with two lateral wings (7, 8) which are raised in relation to the upper surface of the ski. The slide-rail further comprises a mobile base plate (4) which incorporates two laterally-positioned return-shaped members (13, 14) delimiting two symmetrical C-shaped grooves whose openings face opposite each other. The central zone (21) of the plate is bounded laterally by two parallel shoulders (23, 24), each of which incorporates, extending outward, a vertical surface (25, 26) forming a guide and friction surface, against which the lower vertical edges of the return-shaped members (13, 14) are supported and rub during longitudinal movements of the base plate (4).

9 Claims, 3 Drawing Sheets

INTERFACE PLATE FOR THE SLIDE-RAIL OF A MOBILE SKI BINDING, IN PARTICULAR OF AN ALPINE SKI BINDING

FIELD OF THE INVENTION

The invention concerns an interface plate for the slide-rail of a binding, in particular, but not exclusively, an alpine binding, and, in addition, an assembly constituted by an interface plate and the slide-rail of a binding, especially, but not exclusively, an alpine binding.

BACKGROUND OF THE INVENTION

In alpine skiing, it is known that a boot is held on a ski by a front and a rear binding. To ensure that the ski is adapted to boots of different lengths, and also to allow unrestricted flection of the ski, one of the bindings, normally the rear binding, is longitudinally movable along a slide-rail.

Some bindings, in particular rental bindings, also incorporate a front binding that travels along a slide-rail fastened to the ski. This front binding can be placed in different longitudinal positions, thereby allowing adaptation to a wide range of boots of varying lengths.

Slide-rails allowing the longitudinal movement of a binding comprise a stationary part, or base, attached to the ski and a movable element which may, depending on the case, be a base plate on which the base of the binding is assembled, or else the base of the binding, which in this instance incorporates skids to provide for guidance of the body of the binding along the base.

Since the slide-rail comprises an element which moves in relation to a stationary element, the problem of the mechanical adjustment of these two components arises. If the component assembly is too tight, movement of the mobile element along the base proves difficult, thereby hindering adjustment of the longitudinal position of the bindings. In fact, the technician performing this adjustment must exert substantial force in order to move the binding. Furthermore, this movement will tend to occur jerkily and will require several successive back-and-forth motions to put the binding in its correct position. Adjustment procedures of this kind occur relatively frequently in rental skis. It will be easily understood that skiers will not appreciate a binding tightly adjusted in this manner. An excessively-tightened adjustment can also impair flection of the ski when this adjustment is localized between the rear binding and its slide-rail.

If, on the other hand, too much play is left between the two elements of the slide-rail when the boot is absent, the movable element can wobble in relation to the stationary part. This motion causes premature wear of the slide-rail, and, in the long run, deterioration of the binding operation. Moreover, it must be recognized that the skier does not find this motion pleasant, and that it impairs the accurate steering of the ski.

To solve this problem, the French Patent Application published under No. 2 646 093 proposes the insertion, between the two movable elements belonging to the slide-rail, of a layer of elastically-deformable and compressible material. However, the use of the device proves delicate.

Seen from another perspective, it may be recalled that some bindings are equipped with an interface plate located beneath the binding. The main role of this plate is to squeeze the threaded portion of the assembly screws in order to hold them in their holes ready to be screwed in place, until the binding is assembled to the ski. This plate is described, for example, in Japanese Patent Application No. 51-138 254, published under No. 53-65 130. However, there the role of the plate is limited to holding the screws in place, and the plate has no other function.

SUMMARY OF THE INVENTION

One of the objects of the present invention is to take up play between the two movable elements of the slide-rail in bindings equipped with an interface plate, not by means of an added component but by means of the interface plate itself.

Another object of the present invention is to propose an interface plate which, in addition, improves impermeability to snow and dirt between the two movable components of the slide-rail.

A further purpose of the present invention is to object an interface plate which is simple to produce.

The interface plate according to the invention is designed to equip the slide-rail of a binding. This slide-rail comprises a stationary base shaped like an "inverted Ω", of which a central part is attached to the ski and two lateral wings are raised in relation to the upper surface of the ski and extend parallel to the longitudinal axis of the ski. The slide-rail comprises, moreover, a movable base plate incorporating a central portion and two lateral return-shaped members forming two symmetrical C-shaped grooves whose openings face each other, and inside which the lateral wings of the base are engaged. The interface plate is interposed between the base and the upper surface of the ski and incorporates a central zone whose width is substantially equal to the width of the base plate of the slide-rail.

The central zone of the plate is bounded laterally by two lateral edges, each of which has, to the outside, a vertical surface constituting a guide and friction surface, against which the lower edges of the return-shaped members of the movable base plate are supported and rub during translational movements of the base plate.

The assembly comprising an interface plate and the slide-rail of a binding is characterized by the fact that the central zone of the plate is bounded laterally by two parallel shoulders, each of which incorporates, to the outside, a vertical surface forming a guide and friction surface, against which the lower edges of the return-shaped members of the mobile base plate are supported and rub during the translational movements of the base plate, and by the fact that the distance between the lower facing edges of the return-shaped members is equal to, or substantially less than, the distance between the vertical surfaces of the shoulders of the interface plate, while the distance between the vertical surfaces on the bottom of the groove is greater than the distance between the vertical lateral end surfaces of the wings.

BRIEF DESCRIPTION OF THE DRAWINGS

The invention will be better understood by referring to the following description below and to the attached drawings.

DESCRIPTION OF THE PREFERRED EMBODIMENT

Figure 1:
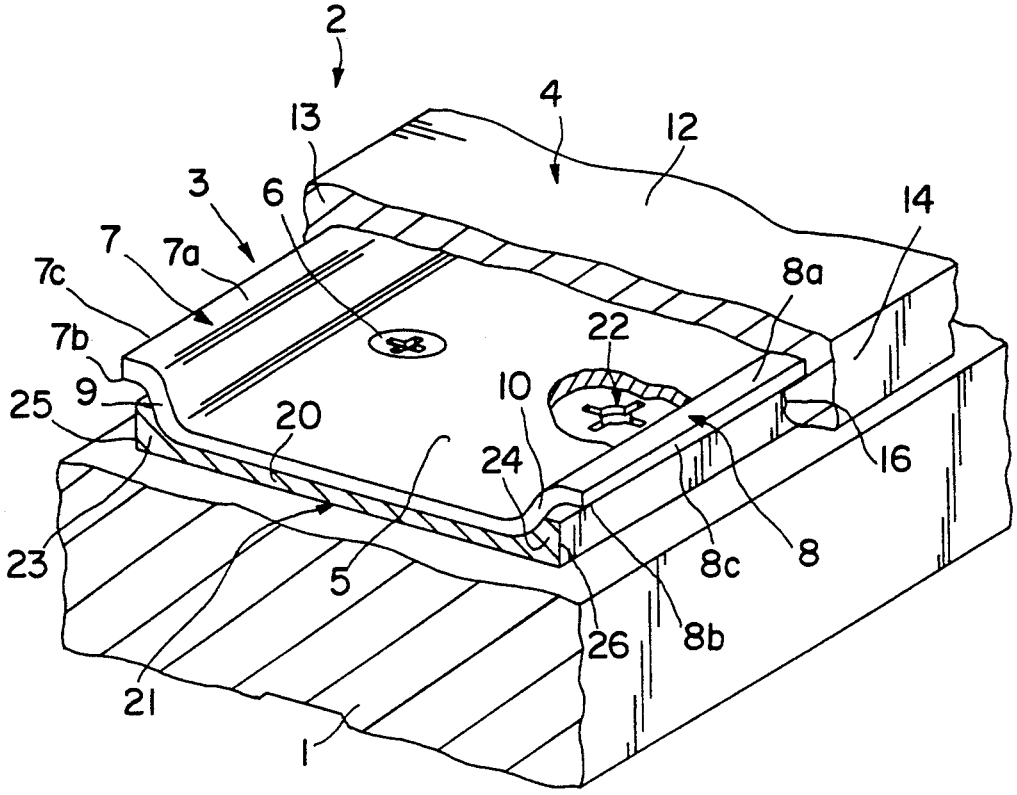
FIG. 1 is a perspective view, in partial cross-section, of a slide-rail of an interface plate mounted on a ski, according to a first embodiment of the invention.

To illustrate the invention, FIG. 1 illustrates a ski 1 on which a slide-rail 2 is assembled. The slide-rail 2 comprises mainly a stationary base 3 fastened to the upper surface of the ski, and a movable base plate 4 which can slide along the base 3 parallel to the longitudinal line described by the ski.

The base plate 4 is designed to receive a ski accessory, e.g., a front or rear binding, a brake, or any other accessory whose longitudinal position along the ski is variable. In addition, means are provided for immobilizing the mobile base plate 4 in relation to the base 3, in specified longitudinal positions. If these means are necessary, they will be of a conventional type not requiring special description.

The base 3 extends along the longitudinal line described by the ski. Its length is approximately equal to the length of the base plate 4, increased by the amplitude of its motion.

The base 3 comprises a central portion 5 assembled to the upper surface of the ski using any suitable means, e.g., screws. A screw is illustrated schematically at 6.

On either side of the central portion 5, the base 3 incorporates two wings 7 and 8 which are raised in relation to the upper surface of the ski and which extend parallel to the longitudinal line described by the ski. The lateral wings 7 and 8 have, respectively, an upper, substantially horizontal surface 7*a*, 8*a*, a lower, substantially horizontal surface 7*b*, 8*b*, and a lateral surface 7*c*, 8*c* facing outward. The movable base plate 4 is guided on these different horizontal surfaces 7*a*, 7*b*, 8*a*, 8*b*; i.e., these surfaces prevent upward or downward movement of the base plate 4.

The wings are connected to the central portion 5 by two strips 9 and 10 which, in the example illustrated, extend obliquely, so that, seen in cross-section, the assembly is shaped approximately like an "inverted Ω."

The base 3 is made of any suitable material, e.g., a metal sheet shaped by drawing.

The movable base plate 4 also incorporates a central portion 12 to which the accessory is assembled. If the latter is a binding, the movable base plate 4 may form part of the binding, i.e., it may be unitary with the body, of which it forms the lower part.

On either side of the central portion 12, movable plate 4 comprises two symmetrical C-shaped return members 13 and 14 whose openings face each other, and which delimit grooves within which the wings 7 and 8 of the base 3 are engaged. The grooves thus delimited have a substantially horizontal upper surface 13*a*, 14*a*, a substantially horizontal lower surface 13*b*, 14*b*, and a lateral surface 13*c*, 14*c*.

Moreover, the lower part of each return-shaped member has a vertical surface 15, 16 positioned to the inside, whose function will be described below. The surfaces 15, 16 face each other.

The base plate is made of any suitable material, e.g., metal or a plastic material, which may be reinforced or fiber-filled.

An interface plate 20 is inserted between the base 3 and the upper surface of the ski. The length of the plate is substantially equal to that of the base, and it further comprises a central zone 21 whose width is substantially equal to the central part 5 of the base. This central zone 21 advantageously has, in the area of the assembly screws, means such as elastic teeth located in a horizontal plane, which squeeze the threaded portion of the screws so as to hold them in their holes in the base 3, until assembly of the base to the upper surface of the ski. These teeth are shown schematically at 22 in FIG. 1.

The central zone 21 of the base plate 20 is bounded laterally by two parallel shoulders 23 and 24, which extend outward in relation to the central portion 5 of the base 3. In the example shown, seen from above, the shoulders 23 and 24 extend beneath the connection strips 9 and 10, and beneath a portion of the wings 7 and 8 of the base 3.

The shoulders preferably follow on the inclination of the connection strips 9 and 10. Each of the shoulders 23 and 24 further incorporates, to the outside, a vertical surface 25, 26 parallel to the longitudinal line described by the ski.

It is on these vertical surfaces 25 and 26 that the lower surfaces 15 and 16 of the two return-shaped members 13 and 14 are supported and rub during the longitudinal movements of the base plate 4. Adjustment and take-up of play between the base plate 4 and the base 3 thus occur in this area. As shown in the drawings slight play exists, moreover, inside the return-shaped members 13 and 14, between the lateral facing surfaces 13*c* and 7*c*, 14*c* and 8*c* of the base and of the base plate. Slight play also exists along a vertical line in this area; however, this vertical play does not greatly impair steering precision of the ski.

To ensure take-up of play transversely, the distance between the two vertical surfaces 25 and 26 of the interface plate is equal to, or very slightly greater than, the distance between the vertical surfaces 15 and 16 of the lower part of the return-shaped members 13 and 14.

Figure 3:
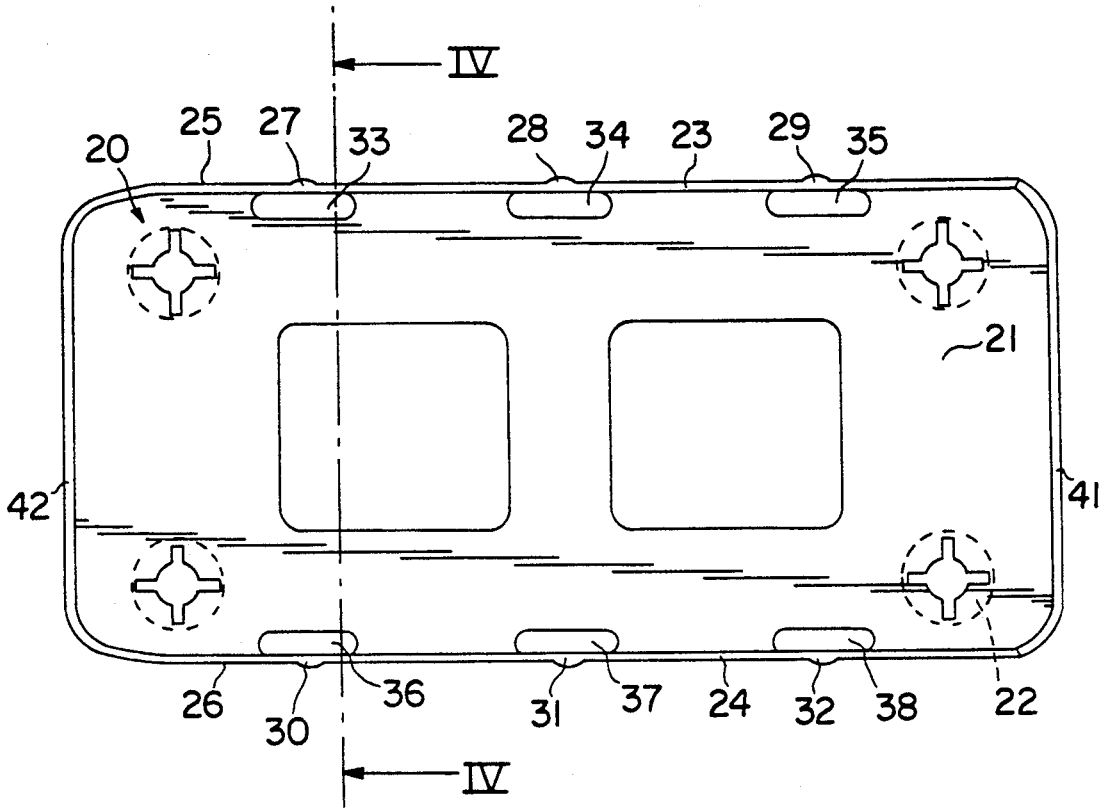
FIG. 3 is a top view of the interface plate according to a preferred embodiment.
Figure 4:
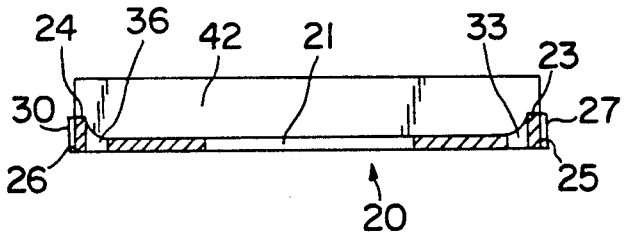
FIG. 4 is a front view of the plate illustrated in FIG. 3.

FIG. 3 illustrates a preferred embodiment of the interface plate, in which the vertical surfaces 25 and 26 have localized bulges 27 to 32 extending outward. They are formed by an accumulation of material and, in the area of these bulges, the central zone 21 of the plate 20 advantageously comprises oblong openings 33 to 38 which extend along the shoulders 25 and 26. Accordingly, at the bulges 27 to 32, the shoulders 25 and 26 are capable of inward elastic deformation at different points. These bulges 27 to 32, in conjunction with the openings 33 to 38, provide for automatic, elastic take-up of play between the base and the base plate.

It may be added that the adjustment between the vertical faces of the interface plate 20 and the lower parts of the return-shaped members 13 and 14 improve impermeability, while reducing the risk of infiltration of snow or dirt between the two slide-rail elements.

Figure 2:
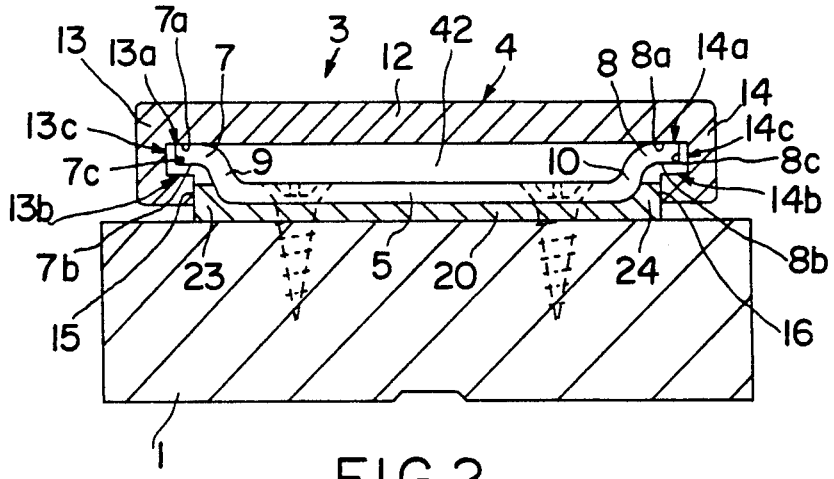
FIG. 2 is a front cross-section of the device in FIG. 1.

This impermeability is further improved by vertical walls 41 and 42 which the plate incorporates on the front and rear, these walls taking on, in fact, the interior shape of the mobile base plate 4. FIG. 2 shows that the wall 42 seals the space between the base 3 and the base plate 4. The same arrangement exists regarding the wall 41. The volume delimited by the base 3 and the base plate 4 is thus protected against dirt.

The interface plate 20 is made of any suitable material. It may advantageously be produced from an injectable or formable synthetic material which preferably has a favorable coefficient of friction. Good results have been obtained using a plate made of polyethylene or a material marketed under the name "Delrin."

Figure 5:
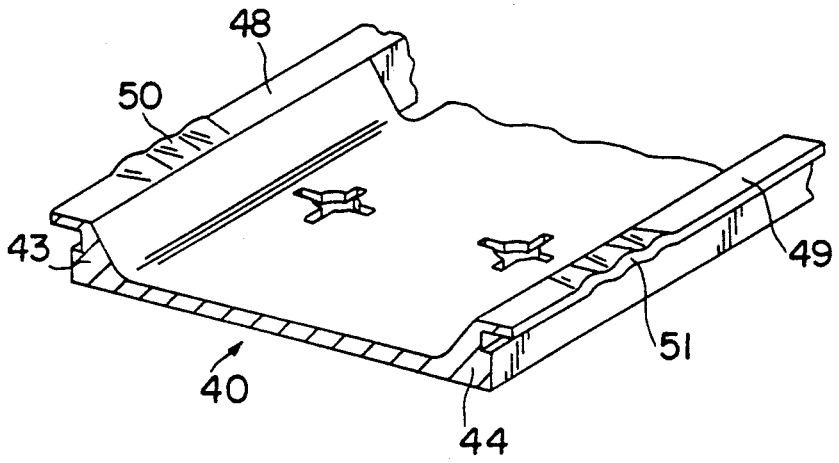
FIG. 5 is a perspective view showing a variant of the interface plate.
Figure 6:
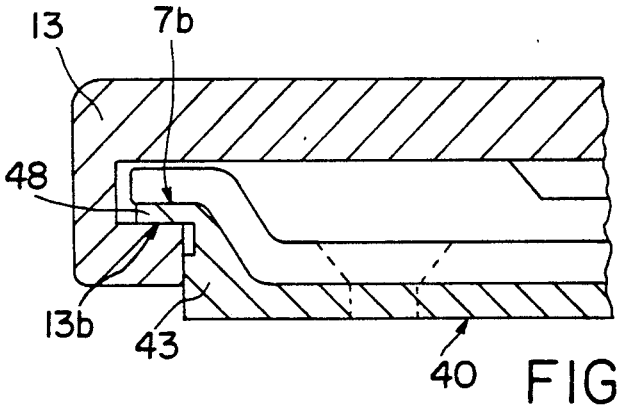
FIG. 6 illustrates the interface plate in FIG. 5 mounted in a slide-rail.

FIG. 5 illustrates a variant in which the interface plate further performs a friction-absorption function and takes up play vertically. Here, the upper parts of the shoulders 43, 44 of the plate are extended outward by two parallel lips 48 and 49 extending in a substantially horizontal plane. As shown in FIG. 6, the lips are designed to be engaged inside the opening of a return-shaped member, between the lower horizontal surfaces of the return-shaped member belonging to the wing. The thickness of the lips is substantially equal to the amplitude of play existing in this area.

According to a preferred embodiment, the lips 48 and 49 have localized vertical undulations. Undulations 50 and 51 appear in FIG. 5. These localized deformations are elastically deformable in a vertical direction, and can thus automatically absorb play between the base plate 4 and the slide-rail 3.

Figure 7:
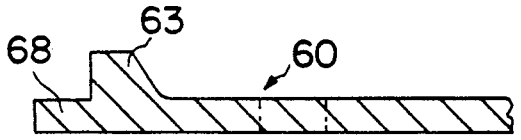
FIG. 7 illustrates an embodiment of the interface plate.

FIG. 7 illustrates and illustrates in a partial view another variant comprising a plate 60 having a shoulder 63 fitted with a horizontal lip 68 for take-up of vertical play.

In this case, the lip is located in the lower part of each shoulder 63. It is the underside of the two return-shaped members 13 and 14 which are supported and rub on the lips vertically and downward. As in the preceding case, the lips 68 take up play vertically. They may also incorporate undulations so as to take up play elastically.

The invention may be used in fields other than alpine skiing, in particular cross-country skiing, surfing, and water-skiing. In addition, as was stated previously, the base plate 4 can be configured so as to receive the accessory, or be made an integral part of that accessory. Finally, means can be added to immobilize the base plate in relation to the base, in specified longitudinal positions.

What is claimed is:

1. Interface plate for a slide-rail associated with a binding of a ski, said slide-rail comprising a stationary base shaped like an inverted Ω and having a central portion fastened to said ski, two lateral wings raised in relation to an upper surface of said ski and extending parallel to a longitudinal axis of said ski, said slide-rail further comprising a moveable base plate having a central part and two lateral return-shaped members forming two symmetrical C-shaped grooves having openings which face each other and inside which said lateral wings belonging to said base are engaged, said interface plate being inserted between said base and said upper surface of said ski and incorporating a central zone having a width substantially equal to a width of said base plate of said slide-rail, said central zone of said plate being bounded laterally by two parallel shoulders, each of which has an outwardly facing vertical surface constituting a guide and friction surface against which lower edges of said return-shaped members of said movable base plate are supported and rub during translational movement of said base plate.

2. Interface plate according to claim 1, wherein at least one of the said shoulders incorporates on its vertical surface at least one localized bulge extending outward and elastically deformable inwardly, said bulge taking up play elastically and transversely.

3. Interface plate according to claim 2, wherein said bulge is formed from a localized accumulation of material and wherein, in the area of said bulge, said central zone incorporates an opening extending along said shoulder so as to make said bulge elastically movable toward the inside of said plate.

4. Interface plate according to claim 3, comprising elastically deformable transverse bulges on said vertical surfaces of said two shoulders.

5. Interface plate according to claim 4, comprising on each vertical surface of said shoulders at least two elastically deformable transverse bulges.

6. Interface plate according to claim 1, wherein each shoulder is extended laterally by a lip located in its upper part, so that it can be engaged between said wings of said base and said return-shaped members of said base plate.

7. Interface plate according to claim 6, wherein each of said lips incorporates at least one vertical undulation capable of taking up play vertically.

8. Interface plate according to claim 1, wherein each shoulder is extended laterally by a horizontal lip located in the lower portion of said shoulder, on which the lower parts of said return-shaped members are supported.

9. Assembly formed by an interface plate and a slide-rail associated with a binding of a ski, said slide-rail comprising a stationary base fastened to said ski and a movable base plate guided along said base, said base being shaped like and invertedΩ and having a central portion fastened to said ski and two parallel lateral wings attached to said ski, said movable base plate having a central portion extending above said central portion of said base and two symmetrical C-shaped lateral grooves with openings which face each other, said lateral wings of said slide-rail being engaged in said grooves, said interface plate being interposed between an upper surface of said ski and said base of said slide-rail and incorporating a central zone having a width which is substantially equal to a width of said base plate of said slide-rail, said central zone of said plate being bounded laterally by two parallel shoulders each incorporating an outwardly facing vertical surface forming a guide and friction surface, against which said lower edges of said return-shaped members of said movable base plate are supported and rub during translational movements of said base plate, and wherein a distance between said facing lower edges of said return-shaped members is equal to, or substantially less than, the distance between said vertical surfaces of said shoulders of said interface plate, while a distance between said vertical surfaces on the bottom of said groove is greater than the distance between said vertical surfaces of said wings.

* * * * *